US006888506B2

(12) United States Patent
Shih

(10) Patent No.: US 6,888,506 B2
(45) Date of Patent: May 3, 2005

(54) PLATE TYPE ANTENNA WITH DUAL CHANNELS

(75) Inventor: Fu-Jen Shih, Shinjuang (TW)

(73) Assignee: Global Sun Technology Inc., Tao Yuan Hsien (TW)

( * ) Notice: Subject to any disclaimer, the term of this patent is extended or adjusted under 35 U.S.C. 154(b) by 65 days.

(21) Appl. No.: 10/372,857

(22) Filed: Feb. 26, 2003

(65) Prior Publication Data

US 2004/0164906 A1 Aug. 26, 2004

(51) Int. Cl.[7] ..... H01Q 1/38

(52) U.S. Cl. ..... 343/702; 343/795

(58) Field of Search ..... 343/700 MS, 702, 343/795

(56) References Cited

U.S. PATENT DOCUMENTS 6,753,818 B2 * 6/2004 Wang ..... 343/702

* cited by examiner

*Primary Examiner*—Michael C. Wimer
(74) *Attorney, Agent, or Firm*—Troxell Law Office, PLLC

(57) ABSTRACT

A plate type antenna for a small size mobile wireless communication device can be simultaneously to fit two different channels of 5.4 $GH_Z$ and 2.4 $GH_Z$ according to the specification of the wireless LAN standard announced by IEEE comprising a first antenna of a pair of "⊓" shaped antenna wiring symmetrically printed on an upside surface of a dielectrical PC board and a second antenna of a "⊓" shaped antenna wiring printed on an underside surface of the PC board coordinately piled under the first antenna wire for producing a reflecting surface yield point sympathy effect to provide two different transmitting channels fitting to the specification of the wireless LAN standard therefore.

6 Claims, 2 Drawing Sheets

PLATE TYPE ANTENNA WITH DUAL CHANNELS

FIELD OF THE INVENTION

The present invention relates to a plate type antenna for a small size mobile wireless communication device especially relates to a dual functional plate type antenna which can be used for covering two different channels to fit the specification of wireless LAN (Local Area Network) standard of IEEE (Institute of Electrical and Electronic Engineers).

BACKGROUND OF THE INVENTION

Recently, since the mobile wireless communication and the wireless LAN have being widely used, a large market of wireless note books, personal digital assistants and portable computers are developed rapidly therefore.

However an antenna will be necessary for any kind of those products for radiating and receiving electronic waves, therefore a designation of an antenna will directly effect the efficiency of the wireless transmission, furthermore, for a portable wireless device the size of an antenna should be reduced, therefore a plate type concealed antenna is used instead of the conventional exposed antenna, and it has a grounded surface of an upside of the plate type antenna to shield interference waves therefor, and further, it provides a better outside looking.

There are two different frequency channels used generally in time now with the specification according to item 802.11a and 802.11b of the wireless LAN standard established by IEEE, which item 802.11a specified a channel of 5.2 $GH_Z$, while item 802.11b specified a channel of 2.4 $GH_Z$. The channel of 5.2 $GH_Z$ provides a higher safety but a shorter transmitting distance in compare with the channel of 2.4 $GH_Z$, therefore a wireless transmitting product has to change another antenna while the product needs to change another channel for transmission, it is inconvenient.

There is a problem of how to use one antenna to fit two different channels, which confuses antenna producers, the inventor of the present invention has been solved aforesaid problem under a long time research and practical test to design a plate type antenna.

Therefore, an object of the present invention is to provide a plate type antenna with dual channels that can be simultaneously used on two specified channels of wireless LAN standard of IEEE. Convenient to use to avoid the trouble of antenna changing.

Another object of the present invention is to provide a plate type antenna with dual channels for reducing the cost of production.

DETAILED DESCRIPTION OF THE PREFERRED EMBODIMENTS

Figure 1B:
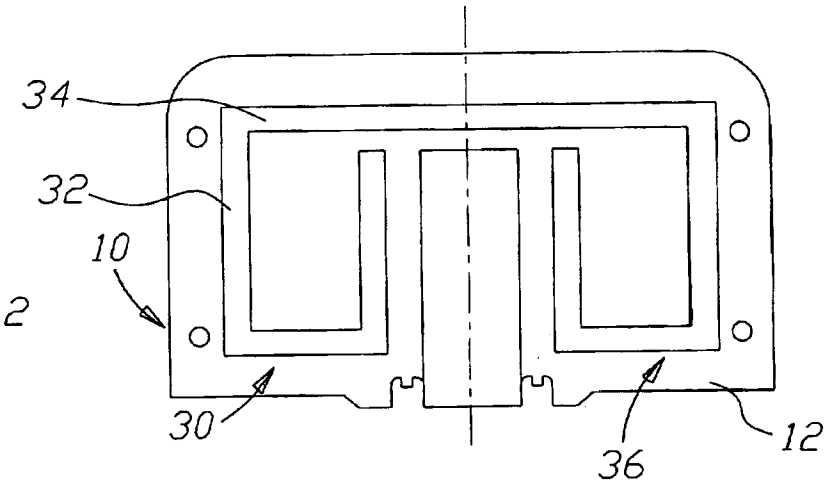
FIG. 1B is a plan diagram of a second antenna circuit according to the present invention.
Figure 1A:
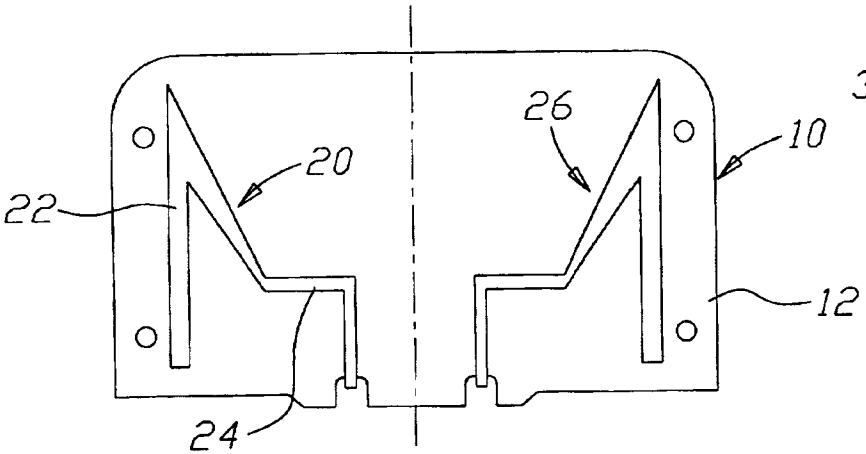
FIG. 1A is a plan diagram of a first antenna circuit according to the present invention.
Figure 2:
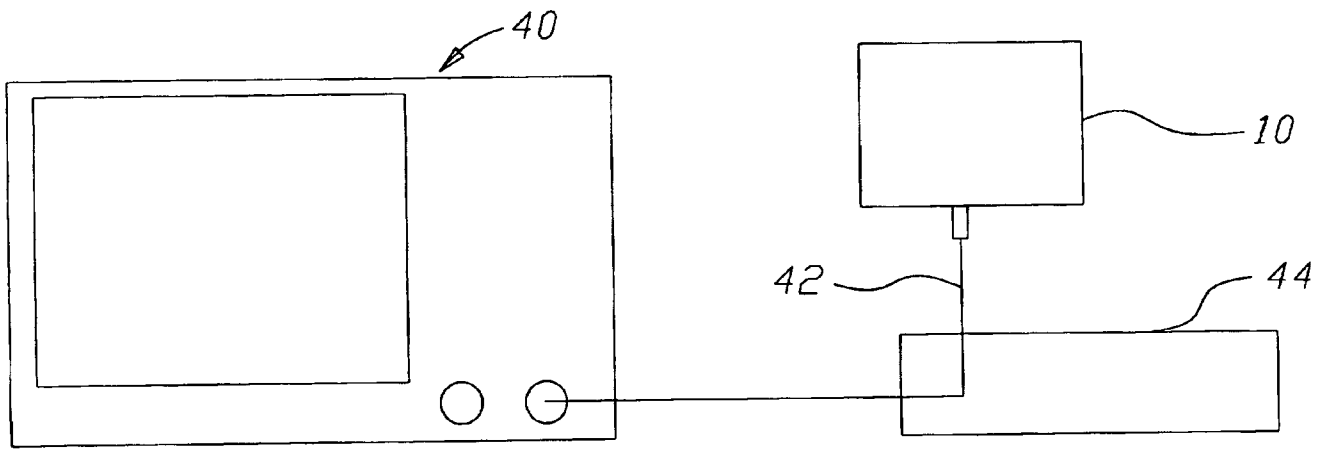
FIG. 2 is a plan view to show an arrangement of a test device for testing a plate type antenna.

Refer to FIG. 1A, a first antenna of the plate type antenna 10 according to the present invention is disposed to an upper surface of a dielectric plate 12 comprising a left side antenna wiring 20 and a right side antenna wiring 26, which the left side wiring 20 is formed of a "⊼" shape composed of a "∧" shaped longer portion 22 having a full length longitudinal path and a half length tilt path, and a "¬" shaped shorter portion 24 having a lateral path and a folded downward path connected continuously to the terminal of the tilt path of the "∧" shaped longer portion 22, while the right side wiring 26 symmetry to the left side wiring opposited from a center line. Meanwhile, the total length of the "∧" shaped longer portion 22 is ranged in 30±2 mm, and the total length of the "¬" shaped shorter portion 24 is ranged in 18±1 mm.

Refer to FIG. 1B, a second antenna 30 of the plate type antenna 10 is formed of a "⊓" shape printed on a reverse surface of the dielectric plate 12 oppositely piled under the first antenna 20, comprising a pair of "U" shaped wirings 32 having a lateral path 34 at a top to connect two extend terminals of opposite outside longitudinal path to formed of a wiring of second antenna therefor.

When the first antenna wiring 20 and the second antenna wiring 30 are piled coordinately on two opposite surfaces of the dielectric plate 12, a resonating effect occurs to provide two different channels of transmission therefor.

Figures 3A, 3B:
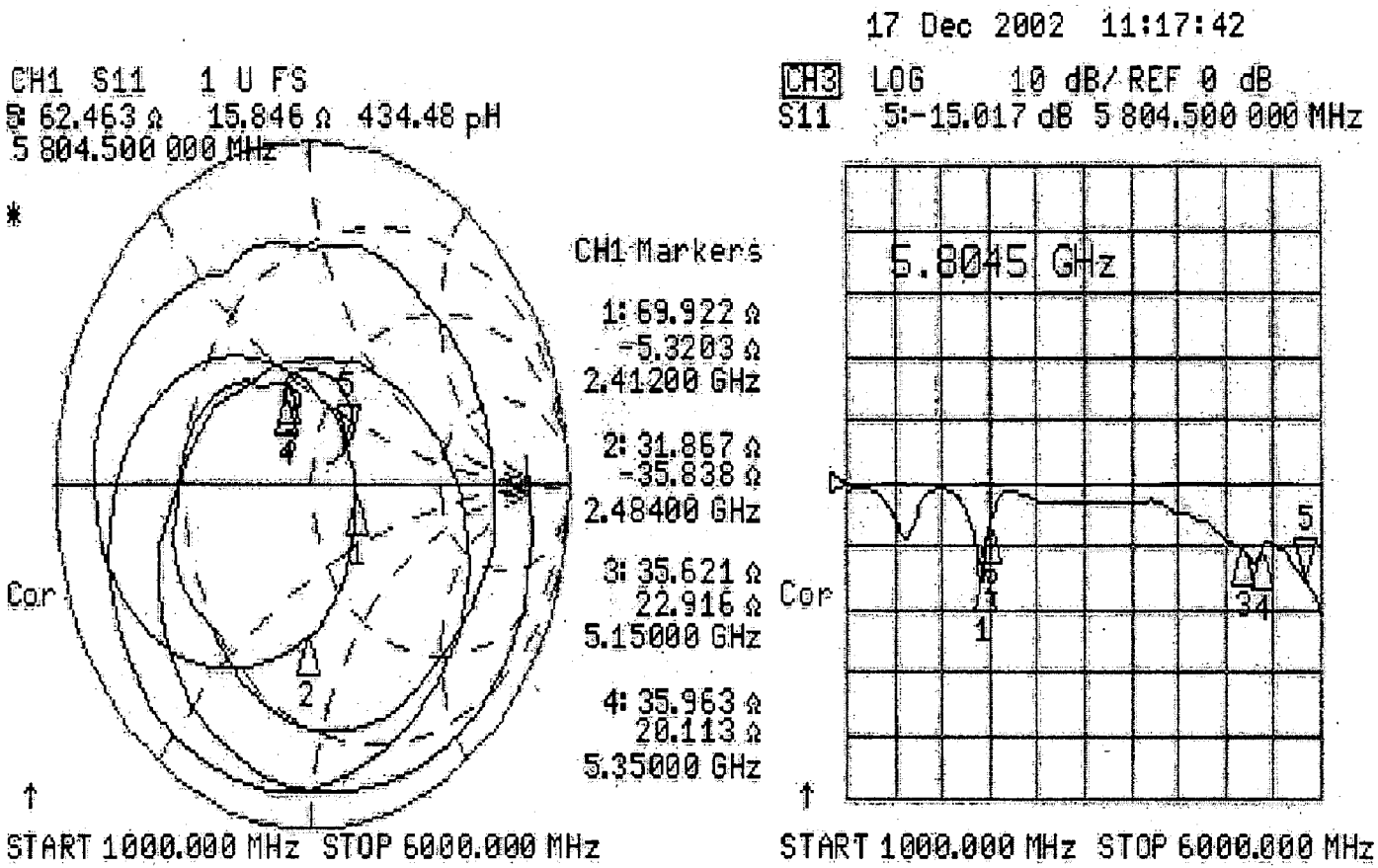
FIG. 3A is a schematic diagram displayed from the test device of FIG. 2 in testing of a plate type antenna according to the present invention.
FIG. 3B is another diagram taken from the test device.

Referring to FIGS. 3A and 3B, there are displayed diagrams showing the result taken from the network analyzer 40 in a test for a testing piece of a plate type antenna 10 of the present invention which two yield points of note 1 and note 3 are located respectively at 2.41 $GH_Z$ and 2.48 $GH_Z$ while two yield points of note 3 and note 4 are respectively located at 5.15 $GH_Z$ and 5.35 $GH_Z$, therefore it indicates that the present invention can cover two different channels of 2.4 $GH_Z$ and 5.4 $GH_Z$ to fit the specification of item 802.11a and 802.11b of the wireless LAN standard.

What is claimed is:

1. A plate type antenna according for a portable wireless device with dual channels comprising: a dielectric material plate having a first antenna located on an upper surface and a second antenna located on a bottom surface thereof;

said first antenna having:

a left side wiring composed of a "∧" shaped longer portion and a "¬" shaped shorter portion, and connected together by a terminal end of said "∧" portion to an initial end of said "¬" portion; and a right side wiring, said left side wiring and right side wiring are symmetrical along a center line; and said second antenna having two "U" shaped wirings having a lateral path at a top to connect two outer up ends of the "U" shaped wirings.

2. The plate type antenna according to claim 1, wherein said dielectric plate is a printed circuit (P.C.) board.

3. The plate type antenna according to claim 1, wherein said first antenna is printed by an electric coating method.

4. The plate type antenna according to claim 1, wherein said second antenna is printed by an electric coating method.

5. The plate type antenna according to claim 1, wherein a total length of said "∧" shaped longer portion of said first antenna is 30±2 mm.

6. A plate type antenna according to claim 1, wherein a total length of said "¬" shaped shorter portion of said first antenna is 18±1 mm.

* * * * *